United States Patent [19]

Banko, Jr.

[11] 4,454,905

[45] Jun. 19, 1984

[54] SHIELD WALL HANGER

[76] Inventor: Michael D. Banko, Jr., 1917 Moravia St. Ext., New Castle, Pa. 16101

[21] Appl. No.: 283,601

[22] Filed: Jul. 15, 1981

[51] Int. Cl.[3] ..... A47G 5/00

[52] U.S. Cl. ..... 160/351

[58] Field of Search ..... 160/135, 350, 351, 173, 160/332, 229 R, 229 B; 40/606, 617; 89/36 R, 36 C, 36 F, 36 G, 36 M, 40 B; 109/10–13, 49.5, 78–85; 211/113, 118; 250/515, 519

[56] References Cited

U.S. PATENT DOCUMENTS

| | | | |
|---|---|---|---|
| 162,250 | 4/1875 | Moore | 160/229 R |
| 633,689 | 9/1899 | Donovan | 160/229 R |
| 1,467,140 | 9/1923 | Meurisse | 40/617 |
| 2,857,525 | 10/1958 | Ferdon | 250/519 |
| 4,034,865 | 7/1977 | Balts et al. | 211/118 |

*Primary Examiner*—Peter M. Caun

*Attorney, Agent, or Firm*—Webb, Burden, Robinson & Webb

[57] ABSTRACT

A shield wall for surrounding radioactive equipment and containers of radioactive waste materials to prevent the escape of radioactivity therefrom. The wall is made of a plurality of spaced vertical rows of elongated hangers which depend downwardly from a support member. Each row of depending hangers consists of a plurality of hangers having an upper end and a lower end with a hole adjacent to the upper end and an outwardly extending pin adjacent to the lower end. The ends of adjacent hangers in each row are attached and a plurality of lead panels is supported on the depending hangers with their adjacent edges overlapping to form a continuous and unbroken wall.

11 Claims, 6 Drawing Figures

SHIELD WALL HANGER

BACKGROUND OF THE INVENTION

1. Field of the Invention

The invention relates generally to the shielding of radioactive equipment and radioactive waste materials stored in containers which are awaiting shipment to a disposal site.

More particularly, the invention relates to hangers for lead shielding panels. A number of hangers are used to support lead panels in the form of blankets or sheets which form a wall positioned relative to radioactive equipment or radioactive waste materials to seal off the area where the radioactive equipment or waste material is located so that personnel can work on equipment in adjacent areas without being subjected to radiation. Lead blankets and lead sheets of various sizes and shapes are presently used to construct walls as shields to protect personnel from radiation, but it is difficult to erect a wall of these panels since they are extremely heavy and cumbersome. Additionally, the walls must be guaranteed not to break or separate in order to insure protection of personnel working in the area. Lead panels are provided in various sizes such as, for example, 6"×12", 12"×12" or 24"×12" and are provided with holes at each corner so that they can be suspended around an area containing a source of radiation. A wall constructed of lead panels is formed with the panels suspended with the edges in overlapping relationship both horizontally and vertically so that there is no radiation leakage at the junction of the individual panels.

2. Description of the Prior Art

In the past the lead panels have been suspended and connected with ties made of rope or wire, but it is difficult to erect a shield wall in this manner as one person must hold an individual panel in place while another person secures the panel to the adjacent panels. The panels are extremely heavy and, hence, erection of a protective lead wall is a difficult and time consuming job. Additionally, ties break and the shield wall loses its integrity. By using hangers in accordance with the invention, a shield wall can be assembled rapidly and relatively easily by only one person and there are no ties to break causing the shield wall to lose its integrity.

SUMMARY OF THE INVENTION

The invention provides a hanger which is used in the erection of lead shield walls around radioactive work areas and storage areas to protect personnel who are required to perform their duties in the vicinity of the radioactive area.

An object of the invention is to provide a lead shield wall which may be suspended from a grid type floor in a building or from individual frames supported on a floor adjacent to a radioactive area.

The object of the invention is obtained by the use of a plurality of hangers according to the invention in the manner hereinafter described and shown in the accompanying drawings, wherein like reference numerals refer to like parts.

DESCRIPTION OF THE PREFERRED EMBODIMENT

Figure 1:
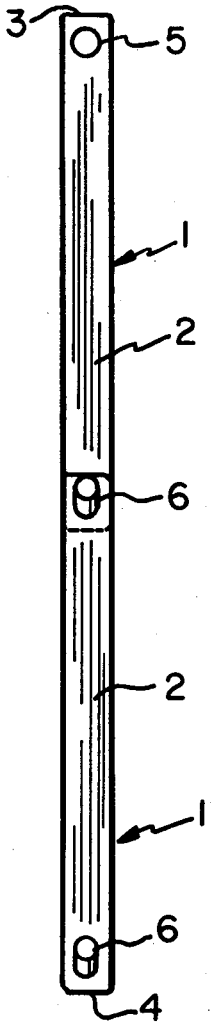
FIG. 1 is a front elevation of two attached hangers.
Figure 2:
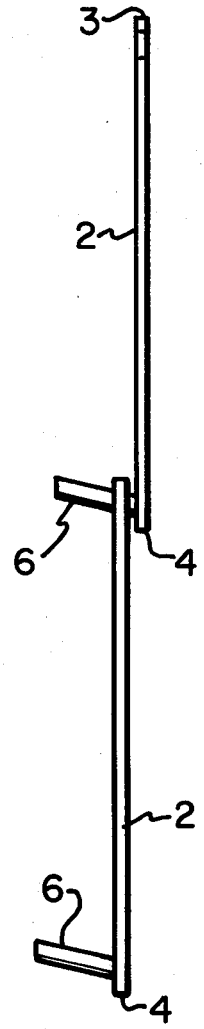
FIG. 2 is a side elevation of two attached hangers.

A hanger 1 according to the invention has an elongated base portion 2 which will vary in length in accordance with the size of the lead panels which are used to form the shield wall. Each hanger has a first or upper end 3 and a second or lower end 4 when the hanger is in the suspended position. A hole 5 is formed in base portion 2 adjacent upper end 3 and a pin 6 is plug welded in a hole in base portion 2 adjacent lower end 4. The hole adjacent upper end 3 of base portion 2 has a diameter slightly larger than the diameter of pin 6 in order that hangers may be hung one from the other in depending relation as shown in FIGS. 1, 2, 3 and 6. Each pin 6 is positioned at an acute angle relative to elongated base 2 of hanger 1 to insure that successive hangers and lead panels suspended thereon do not slide off the pins. The acute angle should be between about 10° and about 20° and an angle of approximately 15° is preferred. The exact angle is not critical so long as the angle is sufficient to retain a hanger and lead panels on the pin. The hanger and the pin are made of steel and may be painted with an epoxy paint to provide a smooth washable surface.

Figure 3:
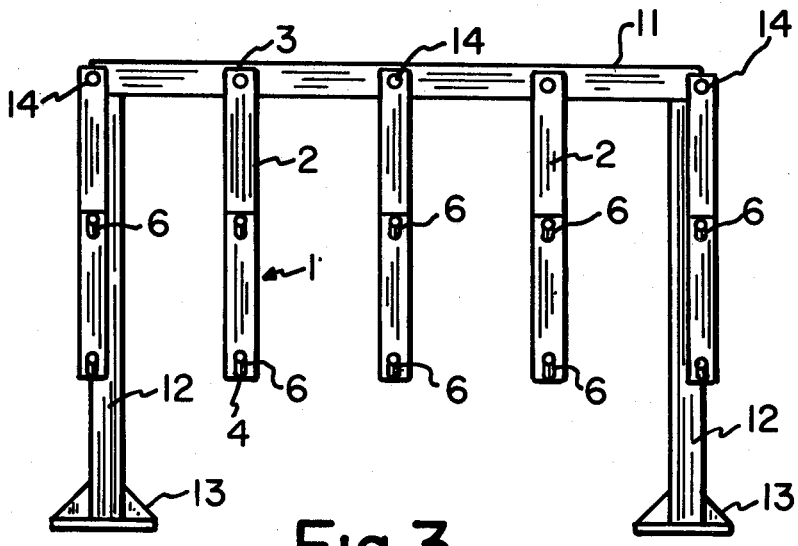
FIG. 3 is an elevation of a plurality of hangers supported on a portable frame.

FIG. 3 shows a portable frame which supports a plurality of rows of hangers 1 for suspending lead panels to form a shield wall. The frame has a horizontal cross member 11 and spaced substantially parallel legs 12 which have feet 13 on their lower end to support the frame. The frame is welded together. A plurality of spaced pins 14 are welded to one face of cross member 11 to support the uppermost hanger in each row of hangers. The frame may be of any length and height depending upon the size of the radioactive equipment or waste material containers which are to be shielded. This frame is used to create a shield wall for equipment or containers of waste material which are not located beneath a building floor or other horizontal building member from which the rows of hangers can be suspended.

Figure 4:
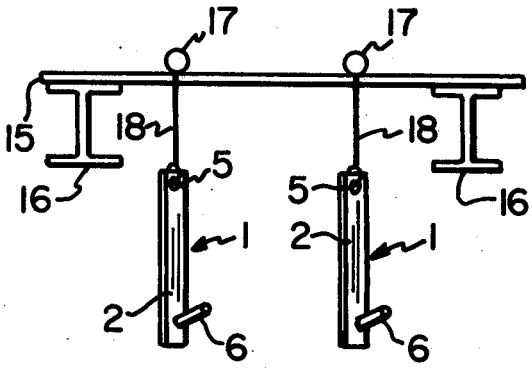
FIG. 4 is an elevation of a plurality of hangers supported from a grid type floor.

If the equipment or containers of waste material to be shielded are located below a building floor, the hangers and the lead panels may be supported by an arrangement such as that shown in FIG. 4 of the drawings. In FIG. 4, the area to be shielded is located below a standard metal grid type building floor 15 which is supported on structural beams 16 of a building. In order to provide support for the top row of hangers 1, bars or pipes 17 are laid across metal grid floor 15, and one end of a woven wire cable 18 is fixed to each bar or pipe 17 and hangs downwardly through the floor. A hanger 1 is tied to the lower end of each cable 18 by looping the lower end of the cable through the hole 5 at the upper end of the hanger so that the hanger depends downwardly from the lower end of the cable. Any number of support bars or pipes 17 may be used along the building floor depending upon the size of the shield wall which is to be constructed.

Figure 5:
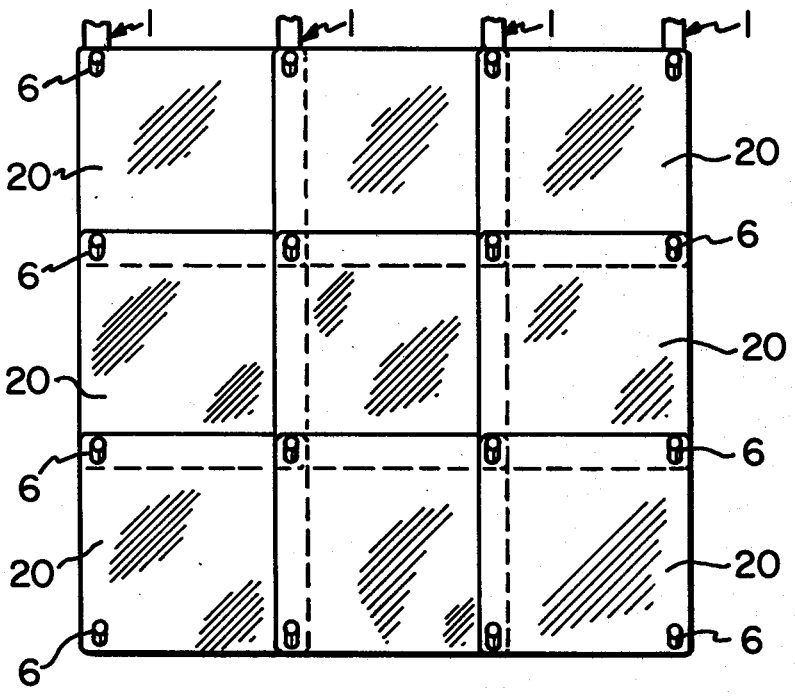
FIG. 5 is an elevation of a plurality of lead panels assembled to form a wall shield.
Figure 6:
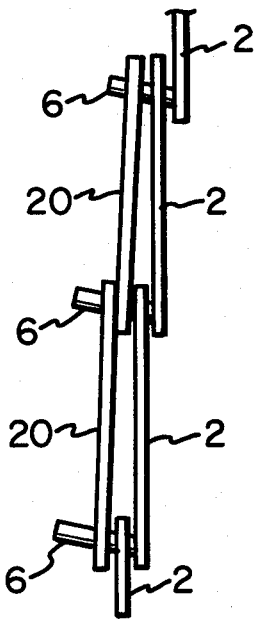
FIG. 6 is a partial end view of the shield wall shown in FIG. 5 with parts broken away.

In FIGS. 5 and 6, a plurality of square lead panels 20 is shown assembled to form a shield wall. Each panel is provided with a hole at each corner which is fitted on a pin 6. The holes are located in such a manner that the individual lead panels overlap as shown in FIG. 6 to form a continuous unbroken wall which prevents leakage of any radiation therethrough. Any number of panels may be used depending upon the size of the panels and the height and length of the area which must be shielded.

The hanger of my invention provides an efficient and inexpensive device for supporting lead panels which may be rapidly assembled by only one workman. The use of the hangers insures that a shield wall made of lead panels will not collapse or separate because of broken ties between adjacent panels.

While a preferred embodiment of the invention is described herein, it is to be understood that the invention may be embodied within the scope of the appended claims.

Iclaim:

1. A continuous shield wall for use in surrounding radioactive equipment and radioactive materials to prevent the escape of radiation therefrom, said shield wall consisting of an elongated upper support member adapted to be suspended from a building structure, means on said upper support member for supporting a plurality of spaced rows of depending hangers, a plurality of spaced rows of depending hangers extending downwardly from said elongated upper support member, each of said hangers having an elongated base portion with opposed substantially parallel uniplanar smooth surfaces, said base portion having a first end and a second end, at least one hole extending through said base portion adjacent to said first end and at least one elongated pin extending outwardly from one of said uniplanar surfaces of said elongated base portion adjacent to said second end, said elongated pin having a substantially linear axis throughout its length and having a continuous substantially smooth surface, each row of depending hangers consisting of a plurality of hangers having their ends attached by inserting an elongated pin at the lower end of a depending hanger through a hole at the upper end of the next lower depending hanger and a plurality of panels removably supported on said hangers with all adjacent vertical and horizontal edges of said panels overlapping to form said continuous shield wall.

2. A continuous shield wall as set forth in claim 1 wherein each elongated pin extends outwardly from said uniplanar surface of a base portion of a hanger at an acute angle to said uniplanar surface.

3. A continuous shield wall as set forth in claim 2 wherein said acute angle is up to about 20°.

4. A continuous shield wall as set forth in claim 2 wherein said acute angle is approximately 15°.

5. A continuous shield wall as set forth in claim 1 wherein said hole extending through said base portion is circular in cross section and said elongated pin is circular in cross section, the diameter of said circular hole being greater than the diameter of said circular pin.

6. A continuous shield wall as set forth in claim 1 wherein said means of said upper support member for supporting said spaced rows of depending hangers is a plurality of downwardly depending cables attached to said upper support member with the spacing between adjacent depending cables being equal to the spacing between adjacent rows of depending hangers.

7. A shield wall as set forth in claim 1 wherein each of said panels has a square configuration, a hole adjacent to each corner of each of said square panels, each of said holes fitting over a pin on a depending hanger, whereby each of said panels is removably supported on a plurality of said hangers.

8. A shield wall as set forth in claim 1 wherein each of said panels has a rectangular configuration, a hole adjacent to each corner of each of said rectangular panels, each of said holes fitting over a pin on a depending hanger, whereby each of said panels is removably supported on a plurality of said hangers.

9. A shield wall as set forth in claim 1 wherein each of said panels is made of lead.

10. A shield wall for use in surrounding radioactive equipment and radioactive materials to prevent the escape of radiation therefrom, said shield wall consisting of a support frame, said frame having an upper cross member and spaced substantially parallel legs extending downwardly from the ends of said upper cross member, a plurality of spaced mounting pins extending outwardly from one vertical face of said upper cross member with the spacing of said mounting pins being equal to the spacing of rows of depending hangers, a plurality of spaced rows of depending elongated flat hangers extending downwardly from said upper cross member, each of said depending hangers having an upper end and a lower end, at least one hole adjacent to said upper end of said hanger and a pin extending outwardly from said hanger adjacent to said lower end, the hole in each hanger in a row being fitted over the pin on the immediately adjacent higher hanger in the row to attach all of said hangers in each row, the upper hanger in each of said spaced rows having the hole adjacent the upper end fitted on a mounting pin on said upper cross member, a plurality of panels, each of said panels being removably supported on said depending hangers with all adjacent vertical and horizontal edges of said panels overlapping to form said shield wall.

11. A shield wall as set forth in claim 10 wherein each of said legs of said frame has a foot on the lower end thereof for supporting said frame.

* * * * *